United States Patent [19]

Hornecker et al.

[11] Patent Number: 4,767,009

[45] Date of Patent: Aug. 30, 1988

[54] MOLD PACKAGE WITH ARTICLE MOUNTING AND PAINT MEANS

[75] Inventors: Timothy Hornecker; Mustoe, Tracy J.; Judy C. Mustoe, all of Eugene, Oreg.

[73] Assignee: Easy Art, Inc., Eugene, Oreg.

[21] Appl. No.: 868,685

[22] Filed: May 30, 1986

[51] Int. Cl.[4] ..... B65D 81/36

[52] U.S. Cl. ..... 206/575; 206/1.7; 206/818; 248/206.5; 335/303

[58] Field of Search ..... 446/70, 73, 74, 75, 446/76; 249/55, 83, 120, 121, 127; 220/376; 206/223, 457, 575, 579, 1.7, 818; 248/206.5; 335/303

[56] References Cited

U.S. PATENT DOCUMENTS

| | | | |
|---|---|---|---|
| 3,921,801 | 11/1975 | Sway | 249/121 X |
| 4,233,586 | 11/1980 | Kaplow et al. | 206/818 |
| 4,287,676 | 9/1981 | Weinhaus | 335/303 |

FOREIGN PATENT DOCUMENTS

| | | | |
|---|---|---|---|
| 2020854 | 11/1971 | Fed. Rep. of Germany | 206/818 |
| 2829440 | 1/1980 | Fed. Rep. of Germany | 206/818 |
| 1157128 | 5/1958 | France | 206/1.7 |

*Primary Examiner*—Jimmy G. Foster

*Attorney, Agent, or Firm*—Chernoff, Vilhauer, McClung & Stenzel

[57] ABSTRACT

A mold package with article mounting and paint means, comprising a package, having recessed molds formed in the cover thereof, for receiving a liquid plaster compound mix to form articles, such as ornaments, berries, animals, and the like. The molds are self-leveling when the closed package is placed on a table, or other level surface, and the package includes a bag of dry plaster compound; a water measuring cup; a plurality of anchors for embedding in the plaster and adhesive backed magnetic pieces for adhering to the anchors so as to mount the finished products to a magnet receiving metal surface, or, in the alternative, a plurality of jewelry pin tacks and clutch backs so as to pin the finished products to clothing and other penetratable materials; a plurality of connected containers of different colored paints; a container of finishing glaze; and a brush for applying the paints and glaze. The anchors are flat and include a center opening across which a web is positioned and integrally attached; a head is also integrally attached to the web and spaced from the bottom surface of the anchor so as to provide improved retention of the anchor in the hardened plaster article produced.

9 Claims, 3 Drawing Sheets

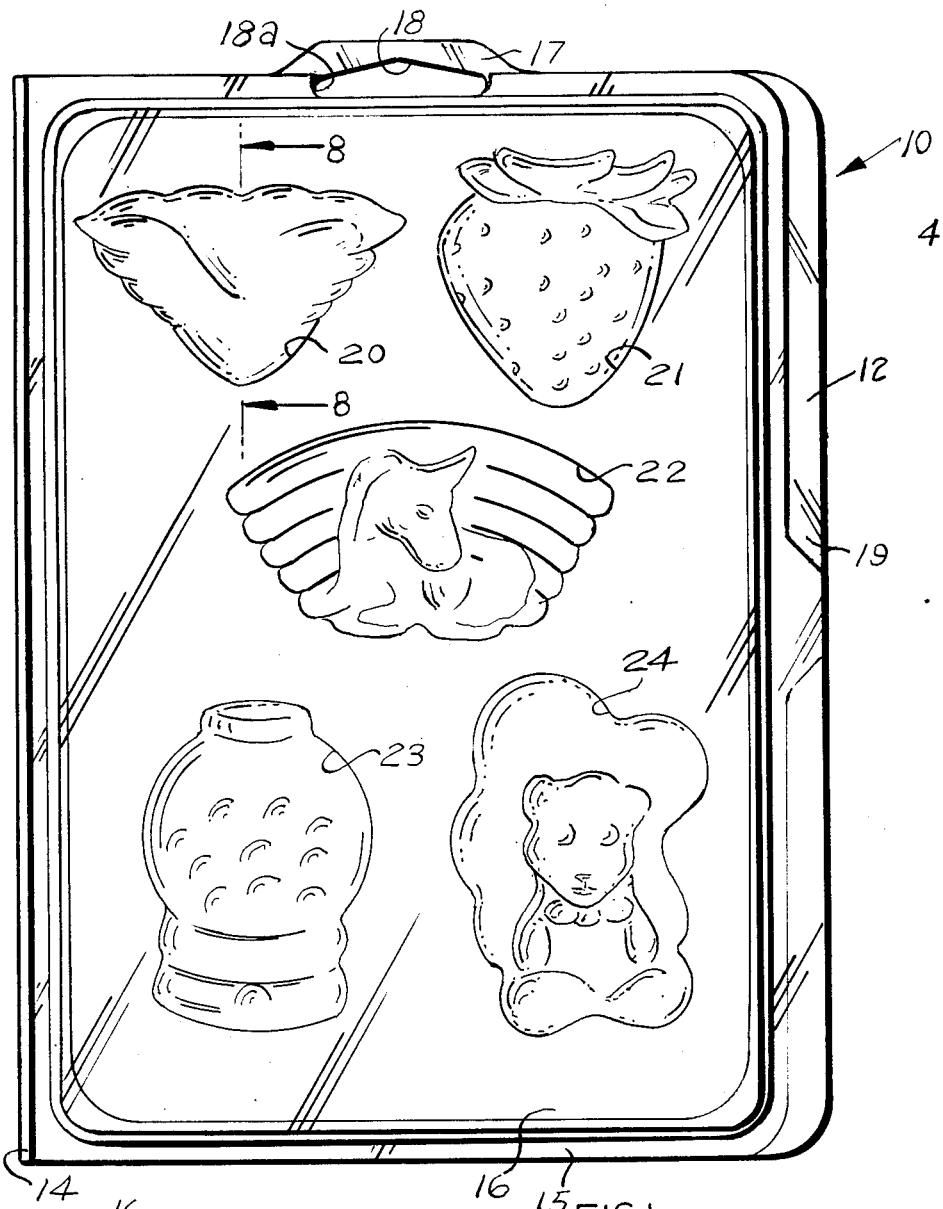
FIG.1
PRIOR ART
FIG.3
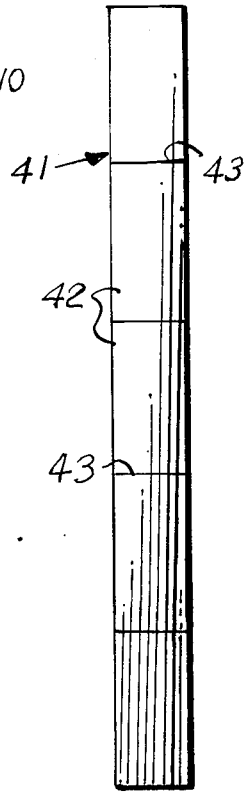
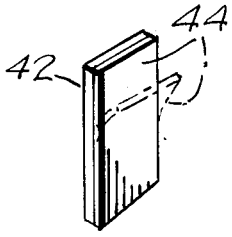
FIG.4
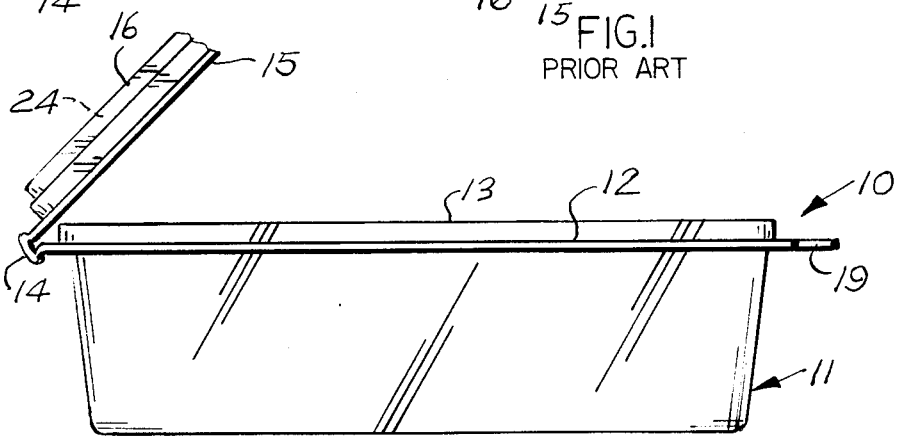
FIG.2
PRIOR ART
FIG.5
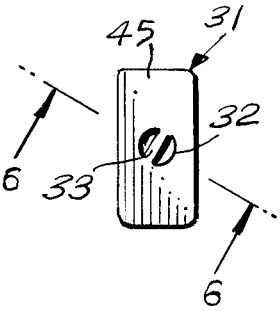

FIG.6
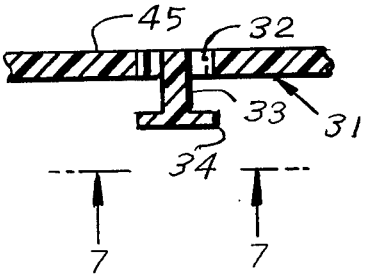
FIG.8
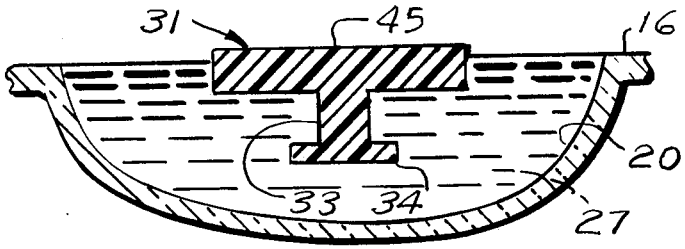
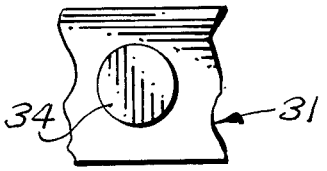
FIG.7
FIG.9
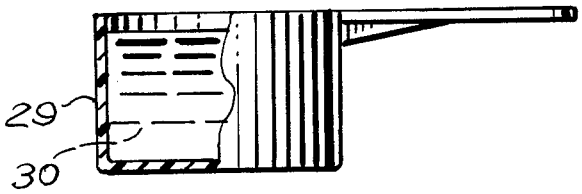
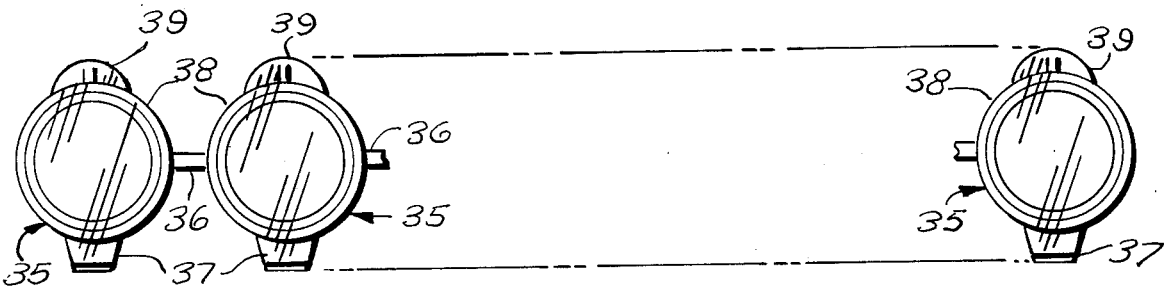
FIG.10
PRIOR ART
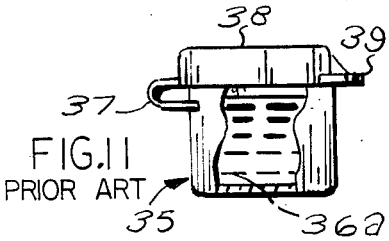
FIG.11
PRIOR ART
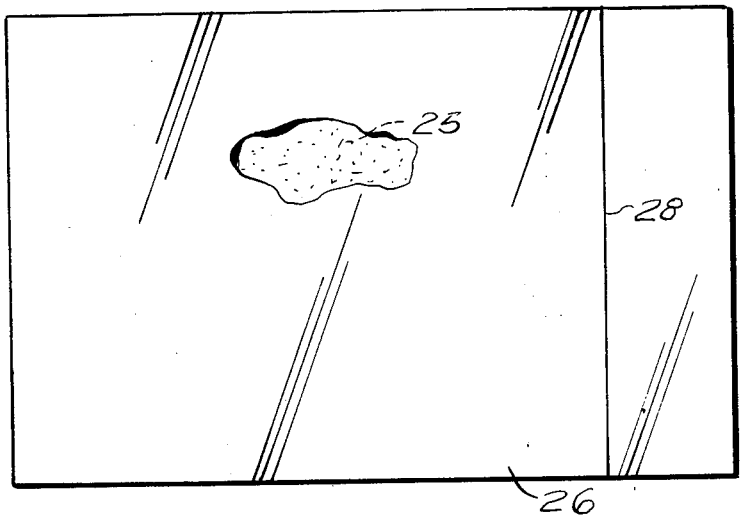
FIG.12
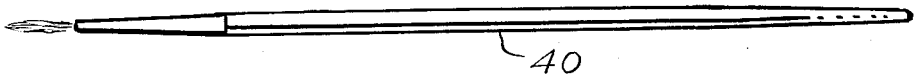
FIG.13
PRIOR ART

MOLD PACKAGE WITH ARTICLE MOUNTING AND PAINT MEANS

BACKGROUND OF THE INVENTION

1. Field of the Invention

The present invention relates to constructive project kits, and more particularly, to a mole package with article mounting and pain means.

2. Description of the Prior Art

Packaged molding kits are known in the art and there are various types. The mold package, in accordance with the present invention, will provide hours of pleasure for young and old alike. The molding package is of such construction that molds are formed therein for easy pouring of plaster compound, and mounting means are also included in the package for mounting the finished products.

The principal object of this invention is to provide a mold package with article mounting and paint means, which will be unique in design in that it will employ a plurality of recessed areas in the top surface of the cover of the package for pouring a plaster compound and water mixture to form articles, such as strawberries, animals, and the like.

Another object of this invention is to provide a mole package with article mounting and paint means which will include a bag of plaster in dry form; a plurality of anchors and magnetic pieces for being secured to the anchors, or in the alternative a plurality of jewelry pin tacks and clutch backs; a plurality of paints for coloring the finished pieces; a liquid glaze for the final finish, and brush means for application of the paints and the glaze.

A further object of this invention is to provide a mold package with article mounting and paint means which will be of such structure as to be self-leveling for the pouring of the liquid plaster compound mixture into the mold forms fabricated into the cover over the base portion.

SUMMARY OF THE INVENTION

A mold package with article mounting and paint means, comprising a package, preferably made of clear plastic, having recessed molds formed in the cover thereof, for receiving a liquid plaster compound mix to form articles, such as ornaments, berries, animals, and the like. The molds are self-leveling when the closed package is placed on a table or other level surface, and the package includes: a bag of dry plaster compound; a water measuring cup; a plurality of unique anchors for embedding in the plaster and adhesive backed magnetic pieces for adhering to the anchors so as to mount the finished products to a magnet receiving metal surface, or, in the alternative, a plurality of jewelry pin tacks and clutch backs so as to pin the finished products to clothing and other penetratable materials; a plurality of containers of different colored paints provided in the package for coloring the finished pieces; a container of finishing glaze; and a brush for applying the paints and glaze.

BRIEF DESCRIPTION OF THE DRAWINGS

FIG. 1 is a top plan view of the mold package, with components removed therefrom, showing the mold portions of cover.

FIG. 2 is a fragmentary side view of the mold package of FIG. 1, shown in elevation and illustrating the cover partially open.

FIG. 3 is a plan view of one of the magnetic strips having multiple magnetic pieces coupled, for being contained in the package.

FIG. 4 is a perspective view of one of the magnetic pieces shown separated from a magnetic strip.

FIG. 5 is a top plan view of one of the plurality of anchors in the package.

FIG. 6 is an enlarged cross-sectional view, taken along the line 6—6 of FIG. 5.

FIG. 7 is a view taken along the line 7—7 of FIG. 6.

FIG. 8 is an enlarged cross-sectional view, taken along the lines 8—8 of FIG. 1, showing a liquid plaster compound mixture therein, with an anchor in place, prior to adhering a magnetic piece thereto.

FIG. 9 is a side view of a water measuring cup, shown in elevation and partially in section.

FIG. 10 is a top plan view of the connected pain containers of the invention.

FIG. 11 is a side view of one of the containers, shown in elevation and partially in section.

FIG. 12 is a plan view of the plaster compound containing envelope of the invention, shown partly broken away.

FIG. 13 is a plan view of the brush of the invention.

DESCRIPTION OF THE PREFERRED EMBODIMENT

Figure 14:
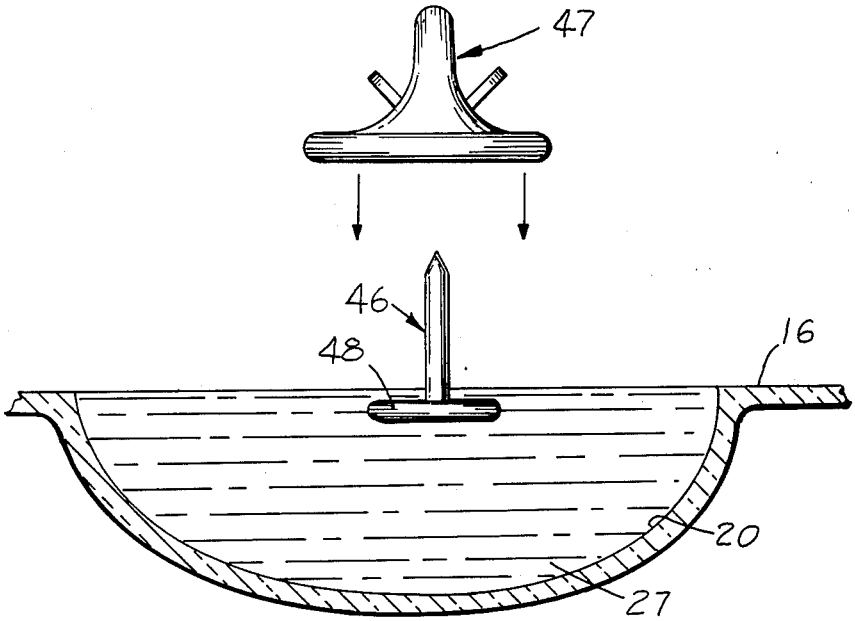
FIG. 14 PRIOR ART
FIG. 14 is an enlarged cross sectional view, similar to FIG. 8 but using, as an alternative mounting means, a jewelry pin tack and clutch back for possible attachment to clothing.

Referring now to the drawings, and more particularly to FIG. 1 and FIG. 2, the preferred embodiments of the mold package 10 is shown to include a clear plastic base 11, having a flange 12 extending outward and spaced from the top edge of base 11. The rear of flange 12 is provided with a hinge portion 14, which is integrally attached thereto, and hinge portion 14 is also integrally attached to flange 15 formed out from the clear plastic cover 16. At the top portion of base 11 is provided a hang portion 17 that protrudes therefrom, and hang portion 17 includes an opening 18 that aligns with a cut-out opening **18*a* in flange 15, the combination providing for receiving a suitable hook for supporting mold package 10 for display means. The forward portions of the flanges 12 and 15 are provided with lips 19** for enabling the user to easily open the package.

A plurality of spaced and recessed mold portions 20, 21, 22, 23, and 24, are formed in the top surface of cover 16, and may be of ornaments, animals, berries, or other figures, as shown in FIG. 1. Dry plaster compound 25 is contained in an envelope 26, as shown in FIG. 12, and the liquid form 27 is shown within a mold 20 on FIG. 8. A seal 28 is provided to enclose the dry plaster compound 25, and envelope 26 is received within the confines of base 11. A plastic measuring cup 29 is received in base 11, for the measurement of water 30 that is to be mixed with the dry plaster compound 25, and a plurality of plastic tabs or anchors 31 are contained in an envelope, not shown, that is also received in the base 11 of the invention. As shown best in FIGS. 5, 6, and 7, each anchor 31 is rectangular, in this instance, and includes a center opening 32, across which a center web 33 is positioned and is interally attached to anchor 31. A head 34 is also integrally attached to web 33, and provides for embedding anchor 31 in the plaster compound liquid form 27 before it hardens, and the top surface 45 being elevated above the article molded in the mold portion 20 as illustrated in FIG. 8. A plurality of paint cups 35, six (6) in the preferred embodiment, are provided and are fabricated of a flexible clear plastic. Cups 35 are attached by web 36 means to each other, and are arranged in semi-circular form within the base 11. Each cup 35 is filled with a different color paint 36*a* for use on the articles produced by the molding process. An additional cup, like cup 35, is also provided, and not shown, which preferably will be placed in the measuring cup 29, this single cup containing finishing glaze for application over the paint 36*a* on the article produced. A flexible hinge 37 is molded to the cup 35, and is also attached to the cover 38 which includes a finger grip tab 39 for opening the cup 35. A brush 40 is also included in the base 11, for the paint 36*a* and glaze application to the finished articles.

A pair of magnetic strips 41 are further included in the base 11, and are made up of five (5) rectangular pieces 42. The pieces 42 are separable from each other by the cuts 43, and each piece 42 is provided with a peel strip 44 that covers an adhesive on one surface thereof. Pieces 42 are adhered to the top exposed surface 45 of the anchors 31, so as to magnetically adher to articles to a magnetically receptive metal surface.

An alternative to use of the anchor 31 and magnetic piece 42 for mounting is the use of a common jewelry pin tack 46 and clutch back 47, as illustrated in FIG. 14. The pin tack 46 and clutch back 47 would be used for mounting the finished article on clothing or other penetratable material. An envelope containing a plurality of pin tacks 46 and clutch backs 47 thus could be included within base 11 in addition to, or as a substitute for, the anchors 31 and magnetic strips 41.

In use, all of the components are removed from the package 10 and the cover 16 is closed. When the cover 16 is closed, the molds will be level and suspended above the base 11 when the package is resting on a table or the like. The envelope 26 is held upright, enabling the plaster compound 25 to settle to one end. The envelope 26 is then cut off at the top below the seal 28, and a cup 29 of water 30 is poured into the envelope 26. The open end of the envelope 26 is then folded down about a quarter of an inch and is creased with the user's fingernail. It is then creased and folded again, afterwhich the folded end is grasped securely and the plaster compound 25 and water 30 are mixed by shaking and crushing with both hands. The mixing should be done vigorously for a full minute.

Optionally, a cup 29 of water 30 may be poured into a paper cup, not shown, and the plaster compound 25 from the envelope 26 sprinkled into the water 30. In this instance, the user must wait for the plaster compound 25 to absorb the water 30, afterwhich the mixture is stirred to a smooth consistency.

The mixture is then poured into the mold portions 20 through 24, and the surfaces between the mold portions 20 through 24 are tapped to level the liquid form 27 and vibrate out any bubbles.

With the top surface 45 up, an anchor 31 is placed in each liquid form 27, the anchors 31 preferably being dropped into the mixture and moved with the blunt end of the brush 40, and in doing so, the top surface 45 of the anchor 31 being positioned in raised condition above the mixture.

If a pin tack 46 is to be used in lieu of an anchor 31, the head 48 of the pin tack 46 is placed in the liquid form 27. Each pin tack 46 is placed toward the top of the mold article so that the article will hang upright when worn.

In approximately 30 minutes, the mixture will set and the finished pieces may be popped out on a towel by flexing the mold portions 20 through 24 back and forth. Any rough edges can be smoothed off with the user's fingernail.

The paints 36*a* are then shaken by holding the connected cups 35 in the hand. A cup 29 of water 30 can be used to rinse the brush 40. The single cup of finishing glaze should be applied when the paint 36*a* is dried.

If using the anchor 31 for mounting, when the article is dry, the strip 41 of magnetic pieces 42 is cut at cut 43, the peel strips 44 is removed and the adhesive side is applied to the surface 45 of the anchor 31 so as to adhere the magnetic piece 42 to the anchor 31.

It is thought that the mold package with article mounting and paint means of the present invention and its many attendant advantages will be understood from the foregoing description and that it will be apparent that various changes in form, construction and arrangement of the parts thereof may be made without departing from the spirit and scope of the invention or sacrificing all of its material advantages, the form hereinbefore described being merely an exemplary embodiment thereof.

I claim:

1. A mold package for creating molded articles of the type which harden from a substantially fluid state to a substantially solid state, said mold package comprising:

(a) a base;

(b) a cover, said cover including a plurality of recessed mold means for forming said molded articles therein;

(c) said base comprising receptacle means for receiving items therein;

(d) mounting means received in said base, for attaching said molded articles to other objects; and (e) said mounting means including anchor means for being partially received within said molded articles when said molded articles are in a substantially fluid state and permanent magnet means, fixable to said anchor means, for mounting said molded articles to a ferromagnetic object.

2. The mold package of claim 1 including attachment menas cooperating between said magnet means and said anchor means for attaching said magnet means to said anchor means.

3. The mold package of claim 2 wherein said attachment means comprises an adhesive.

4. The mold package of claim 1 wherein said magnet means comprises an adhesive-backed flexible magnet strip.

5. The mold package of claim 1 wherein said anchor means includes a substantially planar plate, and retainer means extending perpendicularly from said plate for retaining said anchor means in said molded articles when said molded articles are in a substantially solid state.

6. The mold package of claim 5 wherein said retainer means includes a surface which faces said plate and is substantially parallel thereto.

7. The mold package of claim 5 wherein said retainer means includes a head, spaced perpendicularly from said plate, said head having a surface facing said plate and substantially parallel thereto.

8. The mold package of claim 1, including an envelope of plaster compound, said envelope serving as measuring and mixing means for mixing said plaster compound with water.

9. The mold package of claim 8, including water measuring means for measuring the correct quantity of water to mix with said plaster compound.

* * * * *

UNITED STATES PATENT AND TRADEMARK OFFICE

CERTIFICATE OF CORRECTION

PATENT NO. : 4,767,009

DATED : August 30, 1988

INVENTOR(S) : Timothy Hornecker et al.

It is certified that error appears in the above-identified patent and that said Letters Patent is hereby corrected as shown below:

| | | |
|---|---|---|
| Col. 1, | Line 9 | Change "mole" to --mold--; |
| | Line 10 | Change "pain" to --paint--; |
| | Line 27 | Change "mole" to --mold--. |
| Col. 2, | Line 20 | Change "pain" to --paint--; |
| | Line 67 | Change "interally" to --integrally--. |
| Col. 4, | Line 50 | Change "menas" to --means--. |

Signed and Sealed this

Twenty-seventh Day of March, 1990

*Attest:*

JEFFREY M. SAMUELS

*Attesting Officer*

*Acting Commissioner of Patents and Trademarks*